United States Patent [19]

Rohde

[11] 4,241,513

[45] Dec. 30, 1980

[54] PROCESS AND APPARATUS FOR DRYING AND PREHEATING OF COKING COAL IN A SINGLE FLIGHT STREAM TUBE

[75] Inventor: Wolfgang Rohde, Essen, Fed. Rep. of Germany

[73] Assignees: Bergwerksverband GmbH; Didier Engineering GmbH, both of Essen, Fed. Rep. of Germany

[21] Appl. No.: 70,993

[22] Filed: Aug. 30, 1979

[30] Foreign Application Priority Data

Sep. 21, 1978 [DE] Fed. Rep. of Germany ..... 2841088

[51] Int. Cl.[3] ..... F27B 3/08; F27B 17/00

[52] U.S. Cl. ..... 34/10; 34/57 A; 432/14; 432/58

[58] Field of Search ..... 34/10, 57 A; 432/14, 432/16, 58

[56] References Cited

U.S. PATENT DOCUMENTS

| | | | |
|---|---|---|---|
| 3,403,451 | 10/1968 | Stephanoff | 34/10 |
| 3,518,772 | 7/1970 | Barr | 34/10 |
| 4,102,635 | 7/1978 | Beck | 34/10 |
| 4,178,150 | 12/1979 | Flockenhaus et al. | 432/16 |

*Primary Examiner*—John J. Camby

*Attorney, Agent, or Firm*—Michael J. Striker

[57] ABSTRACT

A process and an apparatus for the drying and preheating of coking coal is described, in which a coarser grain fraction of the starting coal is separated out at least at one location in a flight stream tube through which the coal and a heat carrier gas are fed, and in which this larger grain fraction is subsequently reintroduced into the main stream containing only the finer grain fraction of the coal and the predominant portion of the heat carrier gas. The method and the apparatus through which the method may be carried out allow for a single-step process for both drying and preheating of the coal, make it possible to substantially reduce the length of the flight stream tube necessary, and increase the uniformity of the degree of pretreatment of the variously-sized fractions of the starting material.

8 Claims, 1 Drawing Figure

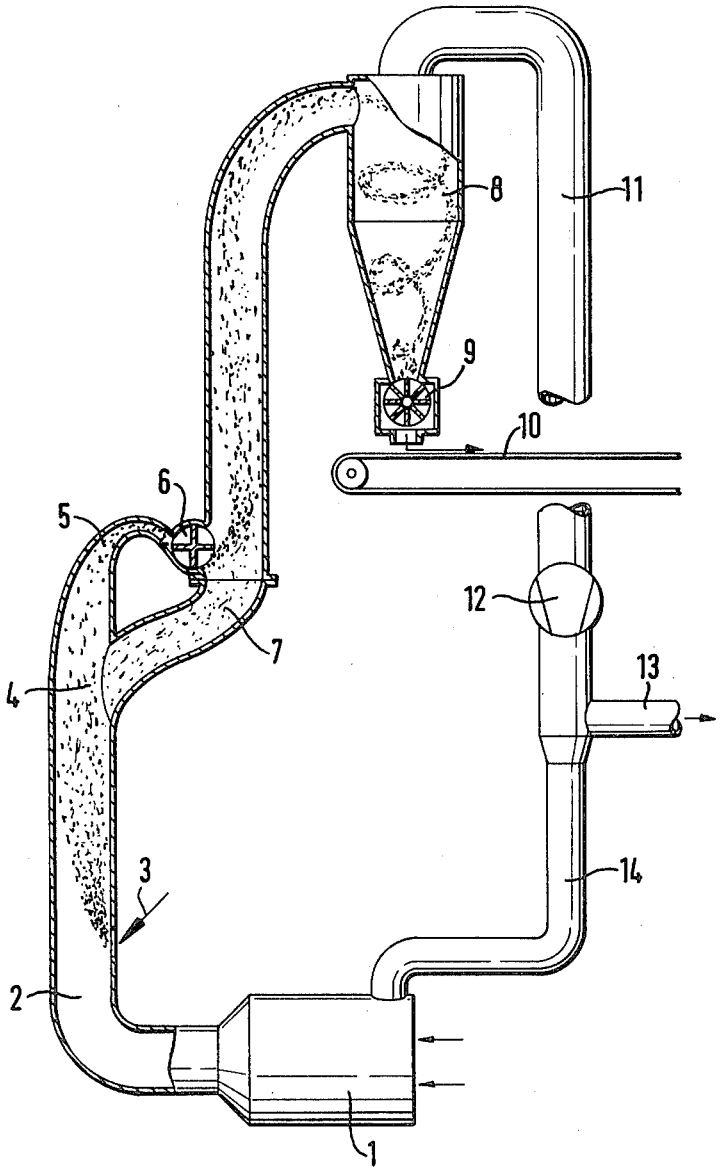
1
2
3
4
5
6
7
8
9
10
11
12
13
14

PROCESS AND APPARATUS FOR DRYING AND PREHEATING OF COKING COAL IN A SINGLE FLIGHT STREAM TUBE

BACKGROUND OF THE INVENTION

The invention concerns a process and an apparatus for the drying and preheating of coking coal in a single flight stream tube.

The drying and preheating of coking coal is currently carried out in single- or multi-step processes, most of which latter comprise two steps. A flight stream apparatus consists of an as a rule vertically standing flight stream tube and one or more subsequent cyclones, in which the separation of gas from solids is carried out. The heat carrier gas is generally prepared in a combustion chamber and mixed vapors which are fed back serve to delimit the temperature. In the pretreatment of coking coal, the first step is a removal of about 10% of the coal moisture; subsequently, there is commonly a preheating of the coal to about 200° C. In a single-step apparatus, only a predrying of the coking coal can now be achieved; for preheating, in contrast, a further process step is required, for example, in a second flight stream tube.

From the so-called Cerchar-preheater it is known, for example, that in a first step the drying of the coking coal may be effected through the use of an entrained bed (a fluidized bed with goods throughput through an especially high turbulence gas speed). In a subsequent flight stream stage—a second step—the coal is then heated to the desired temperature over 200° C.

According to the Precarbon-process it is further known that two flight stream tubes may be operated on the countercurrent principle: i.e., the drying is carried out with the cooler gas from the heating stage and the heating to 200° C with the hotter gas coming directly from the combustion chamber.

Finally, there is also known a type of apparatus in which the heat carrier gas is introduced in two portions into a single flight stream tube: in the lower portion the cooler gas is introduced for the drying of the coking coal and at about half the height of the flight stream tube the hotter heat carrier gas is introduced for preheating the coking coal.

In principle, it would be possible to carry out the drying and preheating of the coking coal in a single-step flight stream tube; nonetheless, this is generally only possible with carrier gas temperatures which lie far above the permissible limit for thermal pretreatment. This is because it is necessary to take precautions not to minimize the coking capacity of the coal through this process.

A principal disadvantage of the known methods for the preheating of coal for coking is the common feature that the ground or milled input material is variously affected by the process in dependence upon the size of the grain. Thus it has been recognized that the drying as well as the preheating process are more rapid as the grain size decreases. As the customary grain size for the ground raw coal ranges from about 6 mm to 0.001 mm, the fine grain fraction of this spectrum is more intensively influenced by the heat treatment than is the middle- and large-grain component.

SUMMARY OF THE INVENTION

It is therefore an object of the invention to provide a method and apparatus for the drying and preheating of coking coal in a single flight stream tube, which allow for the greatest possible uniformity in heat treatment of the ground starting material fractions, and which require the minimum of technical outlay.

This object is achieved by separating the large-grained fraction of the input material at least at one place in the flight stream tube and then directly feeding it into the stream now containing only the finer grained fraction. This may be effectively carried out if the flight stream tube, in the region where the large grain fraction is to be separated out, has a curved path with a main branch not located on the outside of the curve for gas and the finer grain fraction and a subsidiary branch which follows the course of the curve for the larger grain fraction. At the end of the subsidiary branch, a device is provided for reintroduction of the larger grained fraction into the remainder of the flight stream path. The subsidiary branch may be increasingly tapered, and a collecting vessel may be provided prior to the means for reintroducing the large grained fraction.

It has surprizingly been found that through the inventive solution to the problem the length of the flight stream can be substantially decreased. In comparison to the lengths of 40 to 60 m, which were previously required, a length of only 20 to 25 m may be employed. This may be explained by the fact that the separation of the larger grained fraction of the input material from the heat carrier gas which carries the finer grained fraction with it, and the renewed feeding of the large grain fraction into the flight stream, induces for these particles a renewed acceleration phase, which effects an especially intensive surrounding of the particles with heat carrier gas, thereby facilitating heat transfer. On account of this improved heat transfer from the heat carrier gas to the coal grains, in particular to the coarser grain fraction, the length of the flight stream can be shortened relative to those known in the current technology, by at least 20 m. It is also possible to reduce the temperature of the heat carrier gas and still achieve the same degree of preheating as in the prior art processes, but with the advantage that on account of the lower starting temperature of the heat carrier gas of around 500° C., the coking capacity of the starting material is not negatively influenced to the degree customarily associated with the pretreatment.

Through the invention the technical and apparatus solutions employing a two-step preheating process are superseded and at the same time a thorough drying and preheating is achieved in a single-step process.

The inventive process is advantageously carried out with a heat carrier gas of a starting temperature between about 450° and 750° C.

It has also been found according to a further embodiment of the invention that it is particularly advantageous if the subsidiary branch for the larger grain fraction, in comparison to the diameter of the flight stream, is tapered and if a collecting vessel is provided ahead of the means for feeding the larger grain fraction back into the flight stream.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The sole FIGURE illustrates a system for one-step preheating of coking coal with an intermediate separation in the centrifugal field.

DESCRIPTION OF THE PREFERRED EMBODIMENTS

With reference to the sole FIGURE, the heat carrier gas is generated in a combustion chamber 1 and mixed with returned vapor from conduit 14, and then fed into the foot of flight stream tube 2. After this point the moist coal 3 is introduced into the flight stream tube and contacted by the heat carrier gas. At about half the height of the total flight stream tube, the inventive apparatus is provided for the separation of the larger grained fraction and for reintroduction of this fraction into the flight stream containing only the finer grained fraction. The flight stream tube is separated at location 4 into a main branch 7 and a subsidiary branch 5. Through the main branch, the primary portion of the heat carrier gas continues to stream, while through the subsidiary branch only a small residual amount of the original stream of heat carrier gas can pass. The fine and finest grain fractions can continue to follow the main stream of the heat carrier gas on account of their minimal inertia, while the larger grain fraction on account of its higher inertia follows the original course of the flight stream tube. This course is curved in the region of the separation, so that the larger grain fraction on the one hand experiences a centripetal acceleration, and on the other, after its slowing down in the now much slower streaming heat carrier gas, it can no longer fall back into the flight stream tube, but instead is collected in a feeding means 6. The thus-separated larger grain fraction is then reintroduced into the flight stream tube at location 6, and thus back into the heat carrier gas. From there to the separator cyclone 8 the preheating to the desired degree is essentially effected to the desired final temperature and after separation in cyclone 8 and passage through the sluice or floodgate 9 the end product is taken up by conveying means 10. The exhaust from the cyclone 8 passes through vapor conduit 11 and ventilator 12 and is separated into a vapor stream 13, which may be released to the atmosphere, and a return vapor stream which is introduced into the combustion chamber 1 via conduit 14.

It would also be possible to arrange more than one of these systems in a flight stream path, if one wished to further improve the heat transfer. It should also be clear that the inventive process and apparatus for carrying out the process could be employed in conjunction with the other known process techniques, such as for example a feeding of additional heat carrier gas during the course of the flight stream.

The degree of separation into the larger and the finer grained fractions is dependent in a known manner upon the magnitude of the change of direction of the main branch of the flight stream tube in the region of the branching. The greater the degree of directional change, the fewer the grains, i.e., only the fine and finest, that can follow the course of the carrier gas stream.

In combination with the curving of the subsidiary branch, the narrowing of the branch effects a more certain deflection of the particles which are decelerated in this region, thereby prohibiting to a large extent a fall of the particles back into the flight stream.

Different types of feeding means which permit introduction of the solids only in the direction of transport and which are gas permeable may be employed, for example, a rapidly-operating rotary cell-type valve.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a process for drying and preheating particulate coking coal in a single flight stream tube having a lower end portion and an upper end portion, the steps of admitting a hot gas stream into said tube at said lower end portion for travel towards said upper end portion; entraining in said gas stream moist particulate coal which is admitted at said lower end portion in form of a mix of larger and smaller particle fractions; splitting said gas stream into a primary flow containing said smaller fraction and a secondary flow containing said larger fraction; decelerating the particles of said larger fraction; readmitting the decelerated particles of said larger fraction into said primary flow downstream of the location where the gas stream was split, so that the decelerated particles of the larger fraction entering the primary flow carrying the higher-velocity smaller fraction undergo acceleration with concomitant agitation and resulting heat exchange; and separating the dried and preheated larger and smaller fractions of coal particles from said primary flow at said upper end portion.

2. A process as defined in claim 1, wherein the step of decelerating comprises collecting the particles of said larger fraction prior to the step of readmitting.

3. A process as defined in claim 1, wherein the step of admitting is carried out with said gas stream at a temperature between substantially 450°–750° C.

4. In an apparatus for drying and preheating of particulate coal, a combination comprising a flight stream tube having a lower end portion adapted to receive multi-fraction particulate coal, and an upper end portion; means for introducing a stream of heated carrier gas into said tube at said lower end portion, so that the gas stream entrains the multi-fraction particulate coal; means for separating a larger fraction of the entrained coal from a smaller fraction thereof at a predetermined area of the flight stream tube; means for decelerating the particles of the separated larger fraction; means for reintroducing the decelerated particles of the larger fraction into the gas stream and the entrained smaller fraction downstream of said predetermined area, so that the decelerated particles of the larger fraction entering the gas stream carrying the entrained higher-velocity smaller fraction undergo acceleration with concomitant agitation and resulting heat exchange; and means for separating said multi-fraction coal particles from said stream of gas at said upper end portion of said flight stream tube.

5. A combination as defined in claim 4, said tube having generally vertical lower and upper sections which are transversely spaced from one another, and said separating means comprising a curved main tube branch connecting an upper end of said lower section with a lower end of said upper section, and a curved subsidiary branch extending in a loop from said upper end of said lower section to said lower end of said upper section.

6. A combination as defined in claim 5, said decelerating means comprising a convergent cross-section of said subsidiary branch in direction from said lower to said upper section.

7. A combination as defined in claim 5; and further comprising a collecting vessel in said subsidiary branch ahead of said reintroducing means.

8. A combination as defined in claim 5, said reintroducing means being a rotary star valve.

* * * * *